US005697461A

United States Patent [19]

Newton et al.

[11] Patent Number: 5,697,461

[45] Date of Patent: Dec. 16, 1997

[54] ROTARY DRILL BIT HAVING A NON-ROTATING GAUGE SECTION

[75] Inventors: Alex Newton, Houston, Tex.; John M. Fuller, Nailsworth; Andrew Murdock, Stonehouse, both of England; Daniel J. Sarik, Katy, Tex.

[73] Assignee: Camco Drilling Group Ltd. of Hycalog, Stonehouse, England

[21] Appl. No.: 541,995

[22] Filed: Oct. 10, 1995

[30] Foreign Application Priority Data

Oct. 15, 1994 [GB] United Kingdom ..... 9420838

[51] Int. Cl.[6] ..... E21B 10/08; E21B 17/10

[52] U.S. Cl. ..... 175/331; 175/408

[58] Field of Search ..... 175/408, 331, 175/399, 325.3, 325.5

[56] References Cited

U.S. PATENT DOCUMENTS

| | | | |
|---|---|---|---|
| 790,330 | 5/1905 | Terry | 175/325.3 |
| 2,167,194 | 7/1939 | Anderson | 175/325.3 |
| 2,864,601 | 12/1958 | McCarthy et al. | 175/325.3 |
| 3,370,657 | 2/1968 | Antle | 175/325.3 |
| 3,419,091 | 12/1968 | Gardner | 175/399 |
| 3,762,828 | 10/1973 | Faber | 175/408 |
| 4,384,747 | 5/1983 | Hodge . | |
| 4,534,426 | 8/1985 | Hooper | 175/325.3 X |
| 4,549,614 | 10/1985 | Kaalstad et al. | 175/339 |
| 5,099,934 | 3/1992 | Barr | 175/426 X |
| 5,131,478 | 7/1992 | Brett et al. . | |
| 5,339,910 | 8/1994 | Mueller | 175/408 |

FOREIGN PATENT DOCUMENTS

| | | |
|---|---|---|
| 0467580 | 1/1992 | European Pat. Off. . |
| 2625093 | 12/1977 | Germany . |
| 994675 | 2/1983 | U.S.S.R. . |
| 271839 | 3/1928 | United Kingdom . |
| 2238335 | 5/1991 | United Kingdom . |

*Primary Examiner*—Hoang C. Dang

[57] ABSTRACT

A rotary drill bit comprises a bit body, a shank for connection to a drill string, a plurality of cutters mounted on the bit body, and a gauge structure which extends around the bit body and, in use, engages the surrounding formation forming the sides of the borehole being drilled. At least a section of the gauge structure is rotatably mounted on the bit body so that, in use, the gauge section may remain substantially non-rotating in engagement with the formation while the bit body rotates relative to it. The external surface of the non-rotating gauge section may be formed with longitudinal grooves to permit the flow of drilling fluid past the gauge section to the annulus. Alternatively the outer surface of the gauge section may be generally cylindrical, in which case internal passages are provided through the gauge section, and/or the bit body, for the flow of drilling fluid past the gauge section to the annulus.

10 Claims, 3 Drawing Sheets

32
38
37
33
42
40
44
43
39
36
35
34
41

ROTARY DRILL BIT HAVING A NON-ROTATING GAUGE SECTION

BACKGROUND TO THE INVENTION

The invention relates to rotary drill bits of the kind comprising a bit body, a shank for connection to a drill string, a plurality of cutters mounted on the bit body, and a gauge structure which extends around the bit body and, in use, engages the surrounding formation forming the sides of the borehole being drilled.

The invention is particularly, but not exclusively, applicable to drag-type drill bits in which some or all of the cutters are preform (PDC) cutters each formed, at least in part, from polycrystalline diamond. One common form of cutter comprises a tablet, usually circular or part-circular, made up of a superhard table of polycrystalline diamond, providing the front cutting face of the element, bonded to a substrate which is usually of cemented tungsten carbide. The bit body may be machined from solid metal, usually steel, or may be moulded using a powder metallurgy process in which tungsten carbide powder is infiltrated with metal alloy binder in a furnace so as to form a hard matrix.

The invention may also be applied to other types of drill bits, such as roller-cone drill bits.

While drag-type PDC bits of the kind referred to have been very successful in drilling relatively soft formations, they have been less successful in drilling harder formations and soft formations which include harder occlusions or stringers. Although good rates of penetration are possible in harder formations, the PDC cutters may suffer accelerated wear and bit life can be too short to be commercially acceptable.

Studies have suggested that the rapid wear of PDC bits in harder formations is due to chipping of the cutters as a result of impact loads caused by vibration, and that the most harmful vibrations can be attributed to a phenomenon called "bit whirl". Bit whirl arises when the instantaneous axis of rotation of the bit precesses around the central axis of the hole when the diameter of the hole becomes slightly larger than the diameter of the bit. Bit whirl may be initiated, for example, when the drill bit meets a harder occlusion or stringer in the formation which obtrudes into the borehole, at least initially, in only one area of the bottom or sides of the borehole. As each cutter strikes the occlusion or harder formation the bit will try to rotate about the cutter which is for the time being restrained by the harder formation, thus initiating bit whirl.

When a bit begins to whirl some cutters can be moving sideways or backwards relative to the formation and may be moving at much greater velocity than if the bit were rotating truly. Once bit whirl has been initiated, it is difficult to stop since the forces resulting from the bit whirl, such as centrifugal forces, tend to reinforce the effect.

One method which has been employed to overcome the bit whirl is to design the drill bit so that it has, when rotating, an inherent lateral imbalance force which is relatively constant in direction and magnitude. The gauge structure of the bit body then includes one or more low friction pads which are so located as to transmit this lateral imbalance force to the part of the formation which the pad is for the time being engaging. The low friction pad thus tends to slide over the surface of the formation which it engages, thereby reducing the tendency for bit whirl to be initiated.

However, where harder occlusions or formations are encountered, as described above, the direction and/or amplitude of the out of balance force changes as the bit rotates, so that there is no stable out of balance force or direction. Under such conditions the anti-whirl characteristics of such a bit may be reduced or nullified.

The frictional engagement of the gauge structure of a drill bit and the surrounding formation can contribute substantially to the drilling torque and can initiate bit whirl. It has therefore been considered desirable to reduce the diameter of the gauge section relative to the cutting structure to reduce this friction. However, this reduces the ability of the gauge to limit longitudinal and lateral movement.

The present invention sets out to provide a new and improved form of drill bit in which the tendency for bit whirl to be initiated is reduced, without the problems referred to above.

SUMMARY OF THE INVENTION

According to the invention there is provided a rotary drill bit comprising a bit body, a shank for connection to a drill string, a plurality of cutters mounted on the bit body, and a gauge structure which extends around the bit body and, in use, engages the surrounding formation forming the sides of the borehole being drilled, at least a section of said gauge structure being rotatably mounted on the bit body whereby, in use, the gauge section may remain substantially non-rotating in engagement with the formation while the bit body rotates relative thereto.

By providing a gauge section which can remain stationary the invention substantially reduces the frictional restraint to rotation of the bit body, thus reducing the tendency for bit whirl to be induced as a result of frictional engagement between the gauge section and the formation. At the same time, the gauge section may be of any axial length necessary to provide the necessary longitudinal stability of the drill bit. Also, the provision of a non-rotating gauge structure reduces the frictional restraint to rotation of the drill bit. Conventional bit gauges rub on the well bore and the resulting friction can be high, thereby reducing the torque available for drilling.

Preferably the gauge section is formed at its outer periphery with means to engage the formation in a manner to restrain the gauge section against rotation relative to the formation. Said means may comprise elements projecting outwardly from the gauge section to dig into the surrounding formation. Preferably each such element is of small dimension in the peripheral direction, e.g. is knife-edged, to minimise the restraint provided by the element to longitudinal sliding movement of the gauge section along the borehole. It will be appreciated that the non-rotating gauge section must be free to move longitudinally of the borehole, both during drilling and when tripping the drill bit into and out of the borehole.

Each such element may project from a socket in the gauge section, the element being movable inwardly and outwardly of the socket and means, such as spring means, being provided to urge the element outwardly.

Preferably the outer surface of the gauge section is shaped so that only a minor proportion of said outer surface contacts the surrounding formation in use. For example, the gauge section may comprise a plurality of peripherally spaced axially extending projections separated by axially extending grooves.

Alternatively, the outer surface of the gauge section may be a generally cylindrical surface which is substantially entirely in engagement with the surrounding formation, in which case the interior of the gauge section is formed with longitudinally extending passages to permit the flow of drilling fluid through the gauge section and along the annulus between the bit body and the formation.

DETAILED DESCRIPTION OF THE PREFERRED EMBODIMENTS

Figure 1:
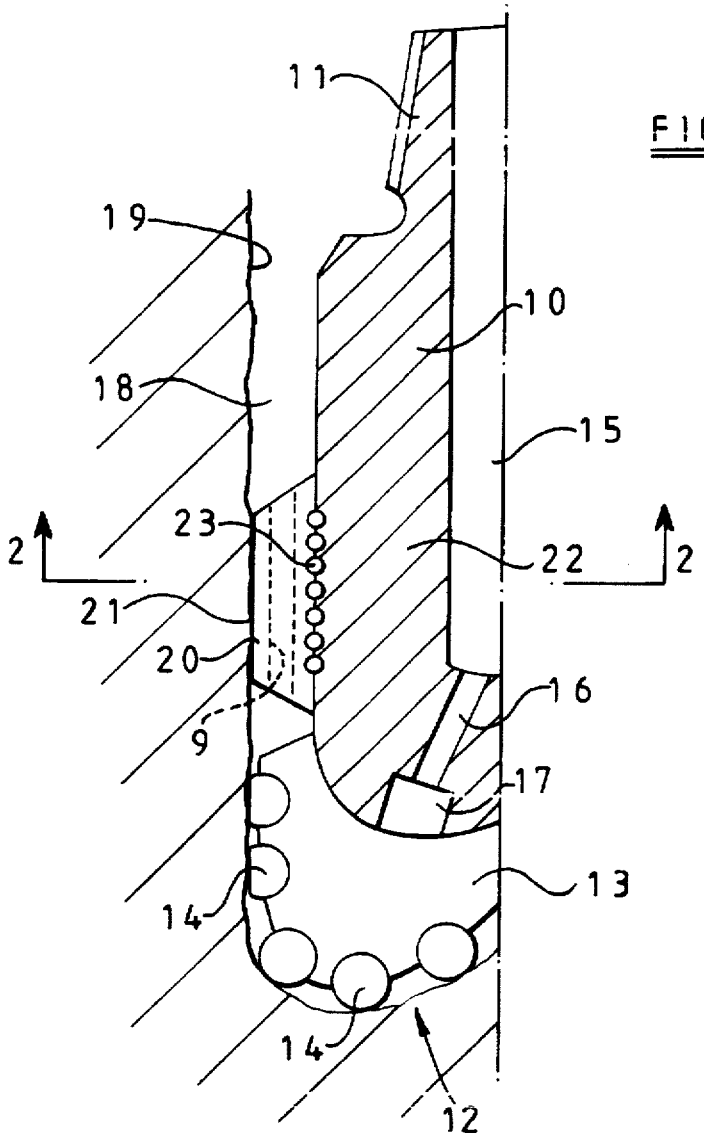
FIG. 1 is a diagrammatic longitudinal half section through a drag-type drill bit in accordance with the invention.

Referring to FIG. 1, the drill bit comprises a bit body 10 having a shank 11 for connection to a drill string. The end face 12 of the bit body is formed with a plurality of radially extending blades 13 and spaced apart along each blade is a series of preform cutters 14.

Each cutter is in the form of a tablet of polycrystalline diamond bonded to a substrate of cemented tungsten carbide, in known manner.

The bit body is formed with a central passage 15 from which subsidiary passages 16 lead to nozzles 17 in the end surface of the bit body. In use, drilling fluid is delivered under pressure through the passage 15 to the nozzles 17, for cooling and cleaning the cutters 14 and for returning the cuttings of formation to the surface upwardly through the annulus 18 between the bit body and the surrounding formation 19.

The bit body is provided with a gauge section which is spaced longitudinally above the end face 12 of the bit and which has an outer surface 21 which engages the surrounding formation forming the sides of the borehole. The gauge section serves primarily to stabilise the drill bit longitudinally within the borehole.

Normally, the gauge section is an integral part of the bit body. In accordance with the present invention, however, the gauge structure 20 is rotatably mounted on a cylindrical portion 22 of the bit body by means of roller or other bearings, as indicated diagrammatically at 23.

Figure 2:
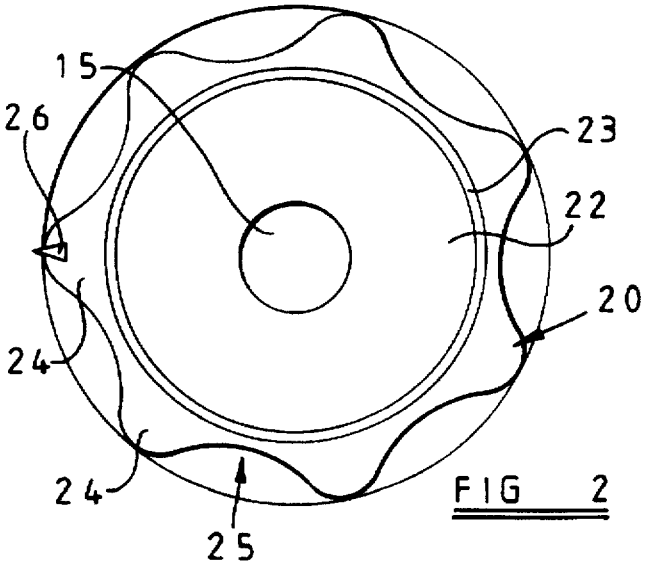
FIG. 2 is a diagrammatic section along the line 2—2 of FIG. 1.

As best seen in FIG. 2, the gauge structure may comprise a plurality of peripherally spaced axially extending lobes 24 separated by axially extending grooves 25 which permit drilling fluid to pass upwardly through the borehole between the gauge structure and the surrounding formation.

In use, the gauge structure 20 frictionally engages the sides of the borehole and is thereby restrained from rotating so that the bit body rotates relative to the gauge structure 20 by virtue of the bearings 23. Accordingly, in the gauge area, the only frictional restraint to rotation of the bit body is provided by the bearings 23 and there is therefore no tendency for bit whirl to be initiated as a result of irregular frictional restraint between the outer surface of the gauge structure and the surrounding formation, as is the case of prior art constructions.

In order to improve the restraint against rotation of the gauge structure 20, one or more of the lobes 24 of the structure may be provided with one or more outwardly projecting scribes 26 which are shaped to dig into the surface of the formation 19. Preferably the scribes extend longitudinally of the gauge section but are of narrow width in the peripheral direction so as to provide minimum restraint to longitudinal sliding movement of the gauge structure 20 along the borehole.

Figure 3:
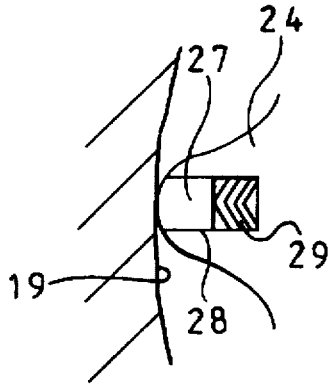
FIG. 3 is an enlarged diagrammatic view of a lobe of a drill bit gauge section in an alternative embodiment.

FIG. 3 shows an alternative form of restraining element where the element 27 is in the form of a longitudinally extending insert or blade which is mounted in a slot 28 in the lobe 24 so as to be slidable inwardly and outwardly. The insert 27 is urged outwardly by springs 29 located between the inner edge of the insert and the bottom of the slot, the springs 29 serving to force the insert 27 outwardly at all times into engagement with the surface 19 of the formation so as to provide increased frictional restraint against rotation of the gauge structure. As in the previously described arrangement the upper and lower edges of the insert 27 are preferably knife-edged to provide minimum resistance to longitudinal movement of the gauge structure along the borehole.

Instead of the gauge section being shaped as shown in FIG. 2 to provide external grooves 25 for the passage of drilling fluid along the annulus, the outer surface of the gauge section may be in the form of a substantially continuous cylinder so that it contacts the surrounding surface of the formation around the whole of its outer peripheral surface. In this case, the part of the gauge section between the bit body 22 and the surrounding formation 19 is formed with longitudinally extending through passages to enable the flow of drilling fluid through the gauge section, as indicated in broken lines at 9 in FIG. 1.

The use of a gauge section having an outer continuous cylindrical surface, with through passages in the gauge section, provides substantial stability to the drill bit and may also be applicable to otherwise conventional drill bits where the gauge section is integral with the bit body, as well as to drill bits of the kind described above where the bit body can rotate relative to the gauge section. It is believed that the tendency for bit whirl to be initiated in an otherwise conventional drill bit may be reduced by providing the gauge section with a continuous outer cylindrical surface substantially all of which is in contact with the surrounding formation as the drill bit rotates.

Although provision of a gauge section having an outer continuous cylindrical surface may help reduce bit vibration, enhance stability and prevent bit whirl, it may give rise to the problem that the bit will not fit down a slightly undersized bore hole. To eliminate this problem the cylindrical gauge may be applied to the pilot portion of a bi-centre bit having an eccentric lobe cutting the required hole size. Such arrangement is shown diagrammatically in FIG. 4.

Figure 4:
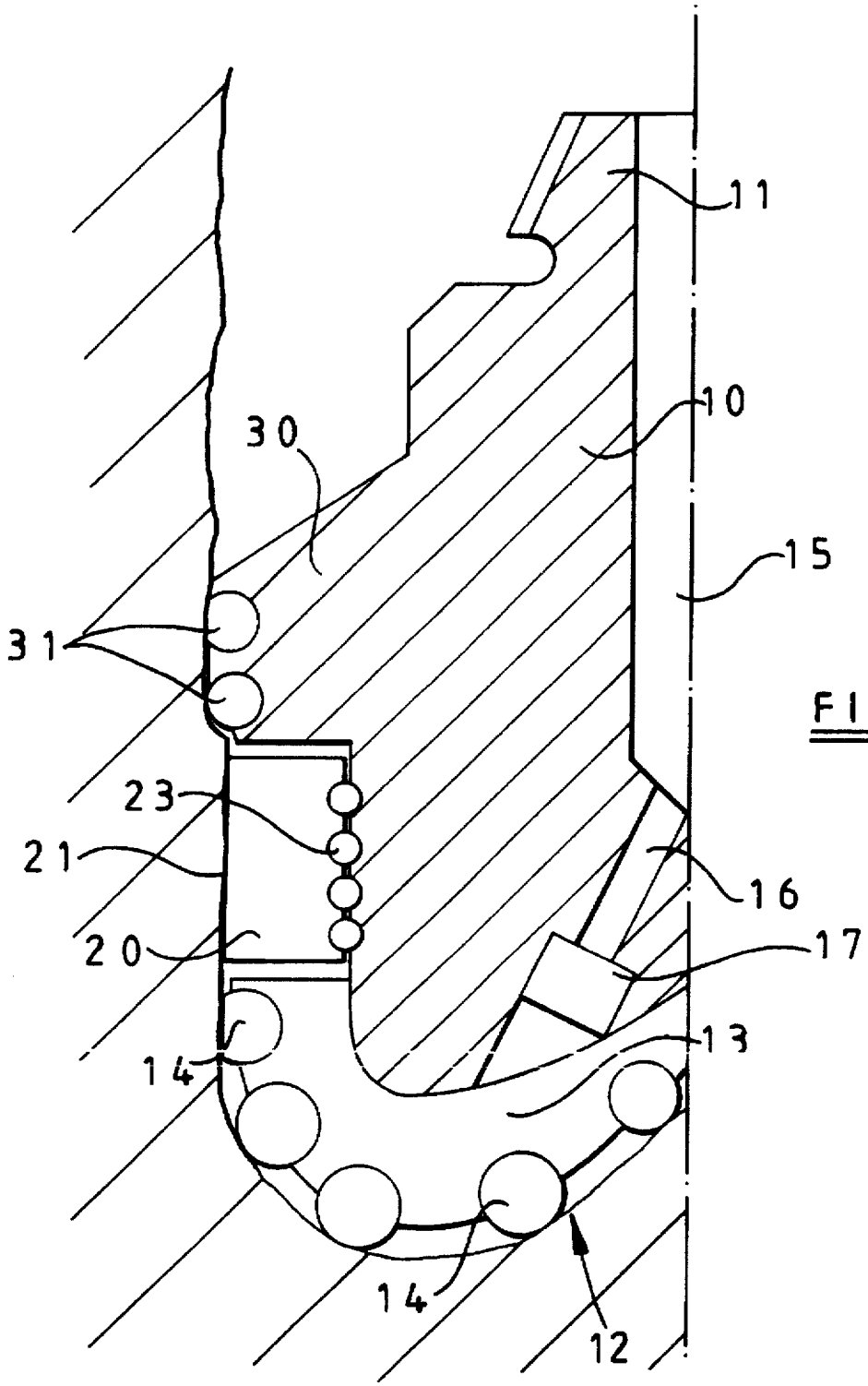
FIG. 4 is a similar view to FIG. 1 of an alternative embodiment.

The arrangement of FIG. 4 is generally similar to the arrangement of FIG. 1 and the same references are therefore used for corresponding elements of the two designs. However, the bit design of FIG. 4 is modified by the provision of an eccentric lobe 30 formed on the bit body 10 above the rotatably mounted gauge structure 20. In the arrangement of FIG. 4 the upper and lower surfaces of the gauge structure 20 are radial instead of being inclined as in the embodiment of FIG. 1.

The eccentric lobe 30 has mounted thereon cutters 31 which may be of similar form to the cutters 14 and these cutters serve to slightly open out the bore hole above the gauge structure 20 so as to facilitate subsequent withdrawal and reentry of the bit into the bore hole. However, when the bit is drilling the outer periphery of the gauge structure 20 will engage the surrounding formation and improve stability and inhibit bit whirl in the manner previously described.

In the arrangement of FIG. 4 the gauge structure, having a substantially continuous cylindrical outer surface, is rotatable with respect to the bit body, but it would be appreciated that a similar problem could arise with a fixed gauge section having a substantially continuous outer cylindrical surface, and an eccentric cutting lobe above such a gauge section could be provided to alleviate the problem in similar manner to the arrangement of FIG. 4.

Figure 5:
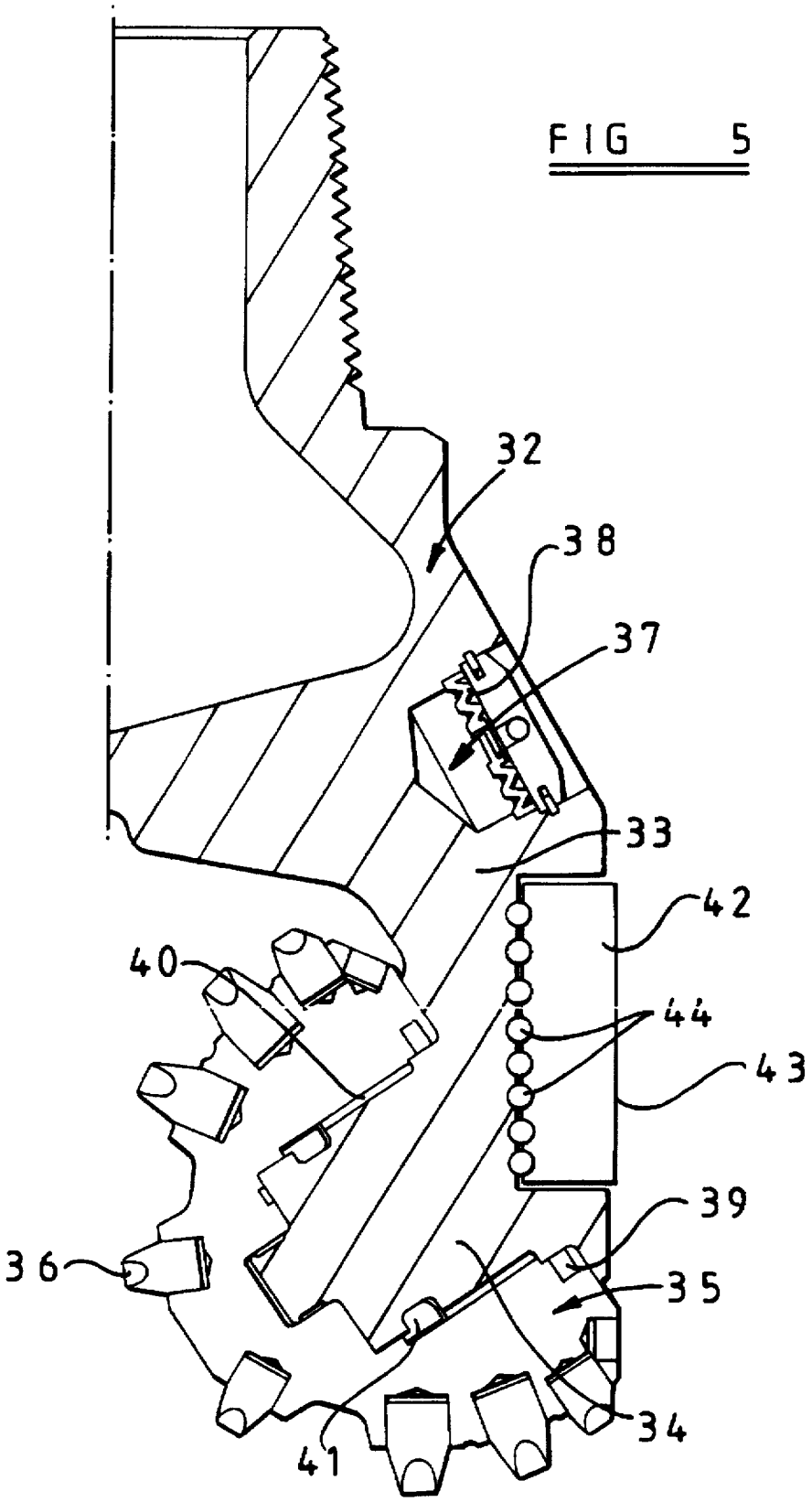
FIG. 5 is a diagrammatic longitudinal half section through a roller-cone drill bit in accordance with the invention.

As previously mentioned the invention is also applicable to roller-cone and other drill bits, in addition to drag-type drill bits of the kinds shown in FIGS. 1–4. The application of the invention to a roller-cone drill bit is shown diagrammatically in FIG. 5 which is a longitudinal half-section through the drill bit.

The drill bit includes a body 32 formed with a downwardly extending peripheral skirt 33. Three cantilevered bearing spindles 34, only one of which is shown, are spaced equally apart around the internal periphery of the skirt 33, and each spindle extends inwardly and downwardly towards the central axis of the drill bit. A generally conical rolling cutter 35 is rotatably mounted upon each spindle 34 as hereinafter described. Attached to the rolling cutter 35 are cutting inserts 36 which engage the earth to effect a drilling action and cause rotation of the rolling cutter 35. Typically, each cutting insert 36 will be formed of hard, wear-resistant material.

Internal passages (not shown) in the bit body, skirt 33 and spindle 34 are filled with lubricant and communicate with a reservoir 37. Pressure differentials between the lubricant and the external environment of the bit are equalised by the movement of a pressure balanced diaphragm 38. The lubricant helps reduce friction during bit operation and is retained within the cutter 35 by a dynamic seal 39. In order to provide a rotary bearing between the rolling cutter 35 and the spindle 35, a separate sliding bearing member 40 is mounted between the spindle 34 and a mating bearing cavity formed in the cutter 35. A retaining ring 41 is screwed into the interior of the cutter 35 and is received within an annular groove around the spindle 34 so as to retain the cutter on the spindle.

The bit body 32 is provided with an annular gauge section 42 which is spaced longitudinally above the lower extremities of the cutters 35 and has an outer surface 43 which engages the surrounding formation forming the sides of the borehole. In accordance with the present invention, the gauge structure 42 encircles the bit body 32 and is rotatably mounted on the bit body by means of roller or other bearings, as indicated diagrammatically at 44.

The gauge structure 42 may be of the same general configuration as shown in FIG. 2 or FIG. 3, i.e. it may comprise a plurality of peripherally spaced axially extending lobes separated by axially extending grooves which permit drilling fluid to pass upwardly between the gauge structure and the surrounding formation and then upwardly along the annulus between the drill string and the walls of the borehole. Alternatively, the outer surface of the gauge section 42 may be in the form of a substantially continuous cylinder so that it contacts the surrounding surface of the formation around substantially the whole of its outer peripheral surface. In this case there are provided, inwardly of the outer surface of the gauge, longitudinally extending through passages to enable the flow of the drilling fluid past the gauge section. Such through passages may be formed in the rotatable gauge section 42 itself or in the bit body inwardly of the rotatable section, or in both said parts.

As in the previously described arrangements, in use the gauge section 42 frictionally engages the sides of the borehole and is thereby restrained from rotating so that the bit body 33 rotates relative to the gauge section 42 by virtue of the bearings 44. The gauge section 42 therefore serves to stabilise the drill bit in the borehole without the drill bit becoming unbalanced as a result of irregular frictional restraint between the outer surface of the gauge structure and the surrounding formation.

As in the previously described arrangements, the outer surface of the gauge section 42 may be provided with projecting scribes or spring-loaded blades of the kind illustrated in FIGS. 2 and 3.

In the arrangements described above the whole of the gauge section 20 is rotatable relative to the bit body. However, the invention includes within its scope arrangements in which only a part of the gauge section is rotatable relative to the bit body, the gauge section including other parts which are integral with the bit body and rotate therewith.

We claim:

1. A roller-cone drill bit comprising a bit body including means at its upper end for connection to a drill string, three rolling cutter bodies rotatably mounted on respective inwardly and downwardly extending spindles spaced substantially equally apart around the bit body, each rolling cutter body carrying a plurality of cutting inserts for engagement with the formation being drilled, a gauge region which extends around the bit body and, in use, engages the surrounding formation forming the sides of the borehole being drilled, the gauge region of the bit body including a gauge section which extends around the bit body and longitudinally below the upper extremities of the cutter bodies and is rotatably mounted on the bit body whereby, in use, the gauge section may remain substantially non-rotating in engagement with the formation while the bit body rotates within the gauge section.

2. A rotary drill bit according to claim 1, wherein the gauge section is formed at its outer periphery with means to engage the formation in a manner to restrain the gauge section against rotation relative to the formation.

3. A rotary drill bit according to claim 2, wherein said means comprise elements projecting outwardly from the gauge section to dig into the surrounding formation.

4. A rotary drill bit according to claim 3, wherein each said element is of small dimension in the peripheral direction, to minimize the restraint provided by the element to longitudinal sliding movement of the gauge section along the borehole.

5. A rotary drill bit according to claim 3, wherein each said element projects from a socket in the gauge section, the element being movable inwardly and outwardly of the socket and means, being provided to urge the element outwardly.

6. A rotary drill bit according to claim 5, wherein said element is urged outwardly of the socket by spring means.

7. A rotary drill bit according to claim 1, wherein the outer surface of the gauge section is shaped so that only a minor proportion of said outer surface contacts the surrounding formation in use.

8. A rotary drill bit according to claim 7, wherein the gauge section comprises a plurality of peripherally spaced axially extending projections separated by axially extending grooves.

9. A rotary drill bit according to claim 1, wherein the outer surface of the gauge section is a generally cylindrical surface which is substantially entirely in engagement with the surrounding formation, the interior of the gauge section being formed with longitudinally extending passages to permit the flow of drilling fluid through the gauge section and along the annulus between the bit body and the formation.

10. A rotary drill bit according to claim 1, wherein the outer surface of the gauge section is a generally cylindrical surface which is substantially entirely in engagement with the surrounding formation, the bit body being formed with longitudinally extending passages to permit the flow of drilling fluid past the gauge section and along the annulus between the bit body and the formation.

* * * * *